US010890864B2

(12) United States Patent
Kato

(10) Patent No.: US 10,890,864 B2
(45) Date of Patent: Jan. 12, 2021

(54) BELT DEVICE, BELT REGULATOR, AND IMAGE FORMING APPARATUS

(71) Applicant: Yuji Kato, Kanagawa (JP)

(72) Inventor: Yuji Kato, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/739,134

(22) Filed: Jan. 10, 2020

(65) Prior Publication Data

US 2020/0241449 A1 Jul. 30, 2020

(30) Foreign Application Priority Data

Jan. 25, 2019 (JP) ..... 2019-011341
Nov. 22, 2019 (JP) ..... 2019-211547

(51) Int. Cl.
*G03G 15/16* (2006.01)

(52) U.S. Cl.
CPC ..... *G03G 15/1615* (2013.01)

(58) Field of Classification Search
CPC ..... G03G 2215/00143–00168
See application file for complete search history.

(56) References Cited

U.S. PATENT DOCUMENTS

2008/0247779 A1* 10/2008 Roetker ..... G03G 15/754 399/162
2012/0087703 A1* 4/2012 Takai ..... G03G 15/6573 399/341
2012/0148300 A1 6/2012 Katoh et al.
2012/0237233 A1 9/2012 Kato et al.
2013/0243482 A1 9/2013 Kato et al.
2014/0008184 A1 1/2014 Hozumi et al.
2014/0072340 A1 3/2014 Kato et al.
2014/0314435 A1 10/2014 Kato et al.
2014/0328603 A1 11/2014 Mizutani et al.
2014/0328604 A1 11/2014 Tanaka et al.
2014/0334847 A1 11/2014 Takahashi et al.
2014/0369721 A1* 12/2014 Miyazawa ..... G03G 15/1615 399/302
2015/0346650 A1 12/2015 Kato et al.
2017/0060043 A1* 3/2017 Kitago ..... G03G 15/1615

FOREIGN PATENT DOCUMENTS

JP 2014-010429 1/2014
JP 2016-061889 4/2016
JP 2017-030907 2/2017

* cited by examiner

*Primary Examiner* — Sevan A Aydin
(74) *Attorney, Agent, or Firm* — Xsensus LLP

(57) ABSTRACT

A belt device includes a belt configured to rotate, a plurality of stretch rollers configured to stretch the belt wound around the plurality of stretch rollers, and a belt alignment mechanism configured to align the belt. At least one of the plurality of stretch rollers has a diameter at a center greater than diameters at both ends in an axial direction of the at least one of the plurality of stretch rollers. The diameter at the center and the diameters at both ends are different from a diameter of the other of the plurality of stretch rollers.

9 Claims, 7 Drawing Sheets

BELT DEVICE, BELT REGULATOR, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-011341, filed on Jan. 25, 2019 and 2019-211547, filed on Nov. 22, 2019, in the Japan Patent Office, the entire disclosure of each of which is hereby incorporated by reference herein.

BACKGROUND

Technical Field

Embodiments of the present disclosure generally relate to a belt device, a belt regulator, and an image forming apparatus.

Description of the Related Art

Some belt devices include a belt, a plurality of stretch rollers that stretches the belt taut, and a belt alignment mechanism.

SUMMARY

Embodiments of the present disclosure describe an improved belt device that includes a belt, a plurality of stretch rollers configured to stretch the belt wound around the plurality of stretch rollers, and a belt alignment mechanism configured to align the belt. At least one of the plurality of stretch rollers has a diameter at a center greater than diameters at both ends in an axial direction of the at least one of the plurality of stretch rollers. The diameter at the center and the diameters at both ends are different from a diameter of the other of the plurality of stretch rollers.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
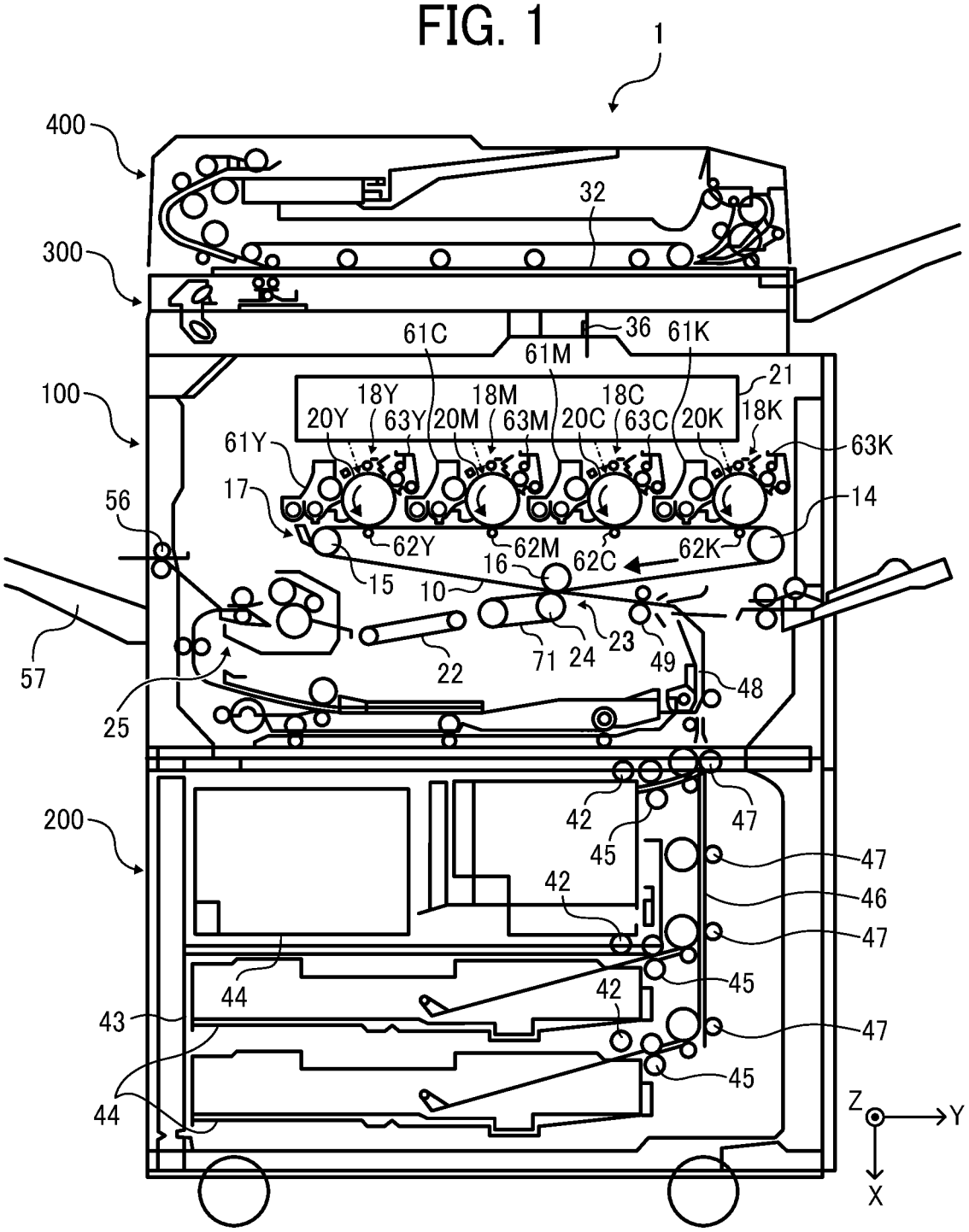
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure applied to a multicolor image forming apparatus of tandem, intermediate transfer type are described below.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic view illustrating an internal configuration of an image forming apparatus 1. The image forming apparatus 1 includes a printer section 100, a sheet feeder 200 on which the printer section 100 is disposed, a scanner 300 disposed on the printer section 100, and an auto document feeder (ADF) 400 disposed on the scanner 300.

The printer section 100 includes an intermediate transfer belt 10, which is an endless belt, as an intermediate transferor. The intermediate transfer belt 10 is wound around a drive roller 14, a driven roller 15, and a secondary transfer backup roller 16 in an inverted triangle shape as viewed from the front side of the image forming apparatus 1 (front side of the surface of the paper on which FIG. 1 is drawn), and is rotated clockwise in FIG. 1 by rotation of the drive roller 14. Above the intermediate transfer belt 10, four image forming units 18Y, 18M, 18C, and 18K are disposed side by side along the direction of rotation of the intermediate transfer belt 10. The image forming units 18Y, 18M, 18C, and 18K form yellow, magenta, cyan, and black toner images, respectively.

The image forming units 18Y, 18M, 18C, and 18K include photoconductors 20Y, 20M, 20C, and 20K, developing devices 61Y, 61M, 61C, and 61K, and cleaning devices 63Y, 63M, 63C, and 63K, respectively. A driver rotates the photoconductors 20Y, 20M, 20C, and 20K counterclockwise in FIG. 1. The developing device 61Y, 61M, 61C, and 61K develop electrostatic latent images formed on the photoconductors 20Y, 20M, 20C, and 20K with yellow, magenta, cyan, and black toners, respectively. The cleaning devices 63Y, 63M, 63C, and 63K remove residual toner adhering to the photoconductors 20Y, 20M, 20C, and 20K that have passed through primary transfer nips, respectively. In the printer section 100, the four image forming units 18Y, 18M, 18C, and 18K arranged along the direction of movement of the intermediate transfer belt 10 constitute a tandem image forming section.

In the printer section 100, an optical writing unit 21 is disposed above the tandem image forming section. The optical writing unit 21 irradiates surfaces of the photoconductors 20Y, 20M, 20C, and 20K with light beams for yellow, magenta, cyan, and black from light sources such as laser diode or light emitting diode (LED) array, thereby forming electrostatic latent images. The charging devices of the image forming units 18Y, 18M, 18C, and 18K charges the surfaces of the photoconductors 20Y, 20M, 20C, and 20K uniformly before optical writing process.

A transfer unit including the intermediate transfer belt 10 further includes primary transfer rollers 62Y, 62M, 62C, and 62K inside the loop of the intermediate transfer belt 10. The primary transfer rollers 62Y, 62M, 62C, and 62K, which are disposed on the back side of the primary transfer nips for yellow, magenta, cyan, and black, press the intermediate transfer belt 10 against the photoconductors 20Y, 20M, 20C, and 20K, respectively.

A secondary transfer unit 23 including a secondary transfer roller 24 and a secondary transfer belt 71 stretched taut by the secondary transfer roller 24 are disposed below the intermediate transfer belt 10. The secondary transfer roller 24 contacts an outer surface of a portion of the intermediate transfer belt 10 wound around the secondary transfer backup roller 16, via the secondary transfer belt 71, thus forming a secondary transfer nip. A recording medium (hereinafter, referred to as "recording sheet") is fed into the secondary transfer nip at a predetermined timing. The four single-color toner images superimposed on the intermediate transfer belt 10 are collectively transferred onto the recording sheet in the secondary transfer nip, thereby forming a multicolor toner image on the recording sheet.

The recording sheet carrying the multicolor toner image is transported to the fixing device 25 by a conveyance belt 22, and the multicolor toner image is fixed on the recording sheet. The recording sheet on which the multicolor toner image is formed is ejected via an output roller pair 56 and stacked on an output tray 57 outside the printer section 100. After passing through the secondary transfer nip and before entering the primary transfer nip for yellow disposed at the extreme upstream of four colors, the surface of the intermediate transfer belt 10 is cleaned by a belt cleaning device 17.

The scanner 300 scans image data for a document on a platen (exposure glass) 32 with a reading sensor 36. The document is transported onto the platen 32 by the ADF 400 or directly placed on the platen 32 by a user. The image data read by the scanner 300 is sent to a controller of the printer section 100. According to the image data received from the scanner 300, the controller controls the light sources such as the laser diode or the LED array disposed inside the optical writing unit 21 of the printer section 100.

The sheet feeder 200 includes a paper bank 43 that accommodates a plurality of sheet trays 44 disposed one above the other, feed rollers 42 each of which picks up a recording sheet from the corresponding sheet tray 44, separation roller pairs 45 each of which separates the recording sheet picked up by the feed roller 42 and guides the recording sheet to a conveyance passage 46, and conveyance roller pairs 47 each of which transports the recording sheet to a conveyance passage 48 of the printer section 100. A registration roller pair 49 is disposed at an end of the conveyance passage 48. The registration roller pair 49 catches the recording sheet transported through the conveyance passage 48 therebetween and then forwards the recording sheet to the secondary transfer nip in the predetermined timing.

Figure 2:
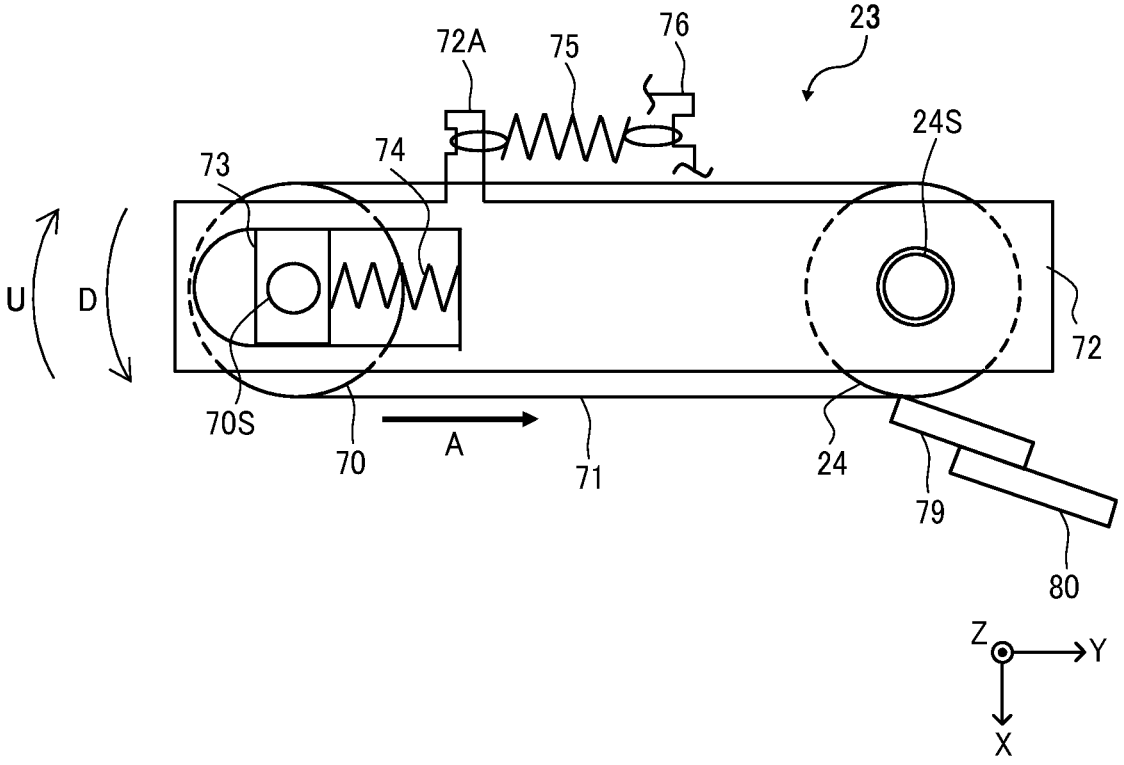
FIG. 2 is a schematic view of a secondary transfer unit (belt device) of the image forming apparatus in FIG. 1.

FIG. 2 is a schematic view illustrating a configuration of the secondary transfer unit 23 as a belt device.

The secondary transfer belt 71 is looped taut, around two stretch rollers (i.e., the secondary transfer roller 24 and a deviation correction roller 70). One of the two stretch rollers functions as the secondary transfer roller 24 that drives the secondary transfer belt 71. The secondary transfer roller is made of, for example, stainless steel, sulfur and sulfur-composite free cutting steel (SUM), or the like, and coated with ethylene-propylene-diene monomer (EPDM) rubber having a thickness of 0.5 mm to ensure good contact with the secondary transfer belt 71 and reliably transmit driving force. The other stretch roller functions as the deviation correction roller 70, to be described in detail later.

The secondary transfer roller 24 and the deviation correction roller 70 are supported by a side plate 72. A spring 74 applies tension to the secondary transfer belt 71. Specifically, the spring 74 applies a load to a bearing 73 that holds a shaft 70S of the deviation correction roller 70.

Specifically, the bearing 73 is disposed outboard of a shaft guide 82 (see FIG. 3) to be described later in an axial direction of the shaft 70S, and the side plate 72 supports the bearing 73. The side plate 72 is rotatable around a shaft 24S of the secondary transfer roller 24 as a rotation center. That is, the side plate 72 is swingable around the shaft 24S. A portion 72A of the side plate 72 is coupled, via a shaft support spring 75, to a stationary portion 76 secured to the frame of the image forming apparatus 1, and the side plate 72 is biased upward indicated by upward biasing force indicated by arrow U in FIG. 2. The shaft support spring 75 is an example of an elastic body, and a flat spring, rubber, or the like may be used instead of the shaft support spring 75.

A cleaning blade 79 to remove toner adhering the secondary transfer belt 71 contacts a portion of the secondary transfer belt 71 wound around the secondary transfer roller 24. The cleaning blade 79 is secured to a holder 80.

In the present embodiment, the secondary transfer belt 71 is made of, for example, polyimide, but the material of the secondary transfer belt 71 is not limited thereto and may be polyamide imide or the like. In the present embodiment, the secondary transfer belt 71 rotates at a speed of 158 to 352.8 mm/s, for example, but is not limited to that speed.

Next, a description is provided of a belt regulator to control movement of the secondary transfer belt 71 in the axial direction of the stretch roller according to the present embodiment.

Figure 3:
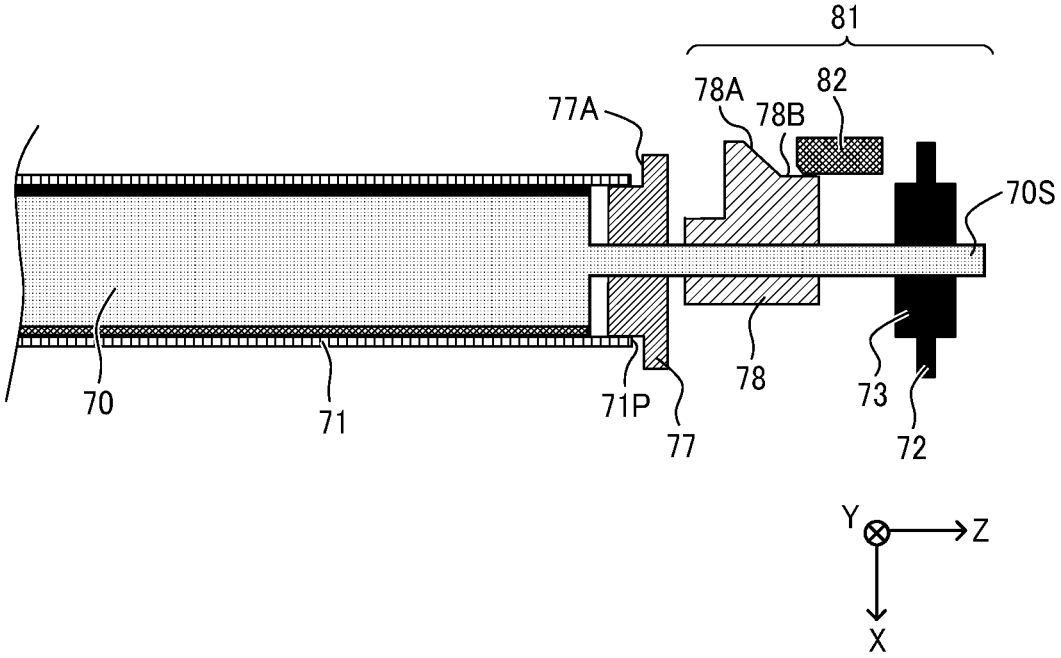
FIG. 3 is a schematic view illustrating a state in which a belt of the belt device in FIG. 2 does not move (deviate) laterally.
Figure 4:
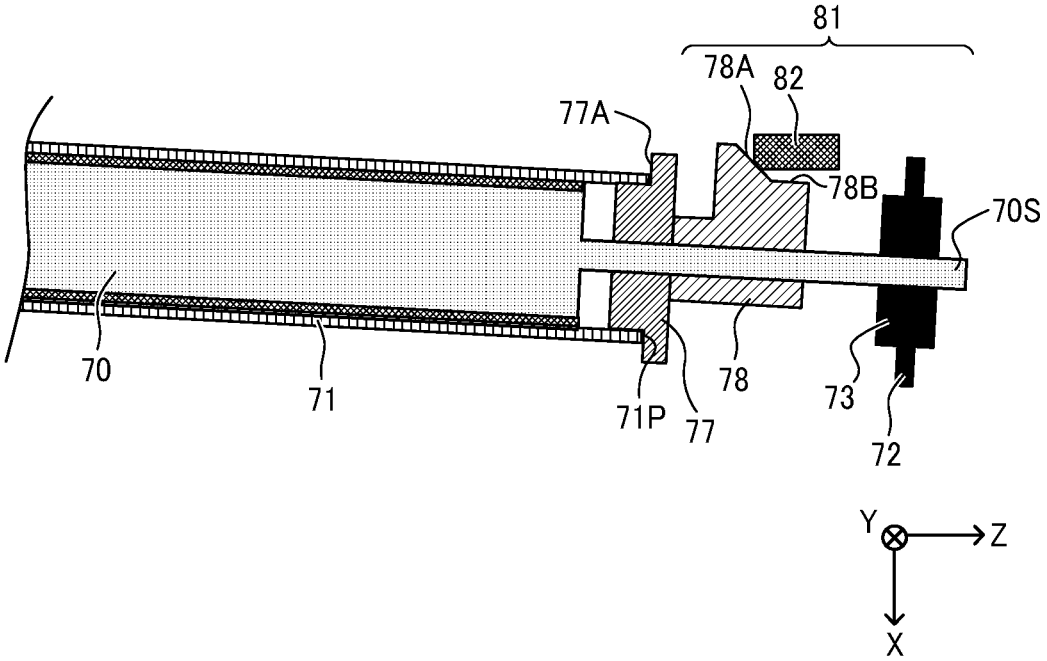
FIG. 4 is a schematic view illustrating a state in which the belt moves (deviates) laterally (to the right in FIG. 4)

FIG. 3 is a cross-sectional view of the deviation correction roller 70 and the surrounding structure when the secondary transfer belt 71 does not deviate. FIG. 4 is a cross-sectional view of the deviation correction roller 70 and the surrounding structure when the secondary transfer belt 71 moves (deviates) laterally, that is, when belt crawl occurs.

The belt regulator according to the present embodiment includes a belt alignment mechanism employing a shaft inclination method to align the secondary transfer belt 71. In the shaft inclination method, force of belt crawl by which the secondary transfer belt 71 moves laterally in the axial direction of the stretch roller causes the stretch roller to incline, thereby generating force of correction to move the secondary transfer belt 71 in the direction opposite to the one side. Note that although FIGS. 3 and 4 depict the belt alignment mechanism at only one end (right side) for simplicity, the belt alignment mechanisms are provided at both ends of the deviation correction roller 70.

The deviation correction roller 70 includes the shaft 70S positioned at the end. The shaft 70S has a cylindrical shape, and a diameter of the shaft 70S is smaller than a diameter of a roller portion of the deviation correction roller 70. The shaft 70S traverses the deviation correction roller 70, a belt contact member 77, a shaft displacement member 78, and the bearing 73. A belt correction unit 81 including the shaft displacement member 78 and the bearing 73 serves as the belt alignment mechanism.

The belt contact member 77 is disposed at the end of the deviation correction roller 70 so as to be movable in the axial direction of the shaft 70S. As the end of the secondary transfer belt 71 (referred to as "a belt end 71P") contacts the belt contact member 77, the belt contact member 77 moves in the axial direction of the shaft 70S of the deviation correction roller 70 (i.e., Z-direction in FIG. 3). The belt contact member 77 has a flat portion 77A that is a plane substantially perpendicular to the axial direction of the shaft 70S. The peripheral edge of the flat portion 77A is circular, and centered on the axis of the deviation correction roller 70. The flat portion 77A is a contact portion with which the belt end 71P of the secondary transfer belt 71 comes into contact when the secondary transfer belt 71 moves outward in the axial direction of the shaft 70S (i.e., the direction from the center toward the end of the deviation correction roller 70).

A radius of the circular peripheral edge of the flat portion 77A is longer than a combined length of a radius of the deviation correction roller 70 plus a thickness of the secondary transfer belt 71 so as to prevent the secondary transfer belt 71 from becoming stranded on the belt contact member 77 and coming off the deviation correction roller 70 when the belt end 71P moves and contacts the flat portion 77A.

The flat portion 77A is only required to function as the contact portion, and the shape of the peripheral edge is not limited to circle but may be a rectangle, a polygon, or any other closed curve. In this case, a distance from the center of the deviation correction roller 70 to the peripheral edge of the rectangle or the like is longer than the combined length of the radius of the deviation correction roller 70 plus the thickness of the secondary transfer belt 71. Further, the flat portion 77A may be a surface having unevenness or curvature, and any shape can be used as long as the flat portion 77A functions as the contact portion of the belt end 71P.

Further, the belt contact member 77 is not secured to the deviation correction roller 70 and the shaft 70S, but freely rotatable coaxially to the axis of the deviation correction roller 70 in the X-Y plane in FIG. 3. For this reason, when the secondary transfer belt 71 rotates while contacting the flat portion 77A, the belt contact member 77 is driven to rotate along with the secondary transfer belt 71 by friction between the belt end 71P and the flat portion 77A.

The belt correction unit 81 acts to return the secondary transfer belt 71, which has moved in the axial direction of the shaft 70S, to the original position. The belt correction unit 81 includes: the shaft displacement member 78, the shaft guide 82, the bearing 73, and the side plate 72 illustrated in FIG. 3; and the shaft support spring 75 illustrated in FIG. 2.

An inward surface of the shaft displacement member 78 can contact the belt contact member 77 in the axial direction of the shaft 70S. The shaft displacement member 78 is moved outward in the axial direction of the shaft 70S by push of the belt contact member 77. The shaft displacement member 78 has an inclined face 78A on the outside in the axial direction of the shaft 70S. The inclined face 78A is a flat surface descending at an angle outward in the axial direction of the shaft 70S with respect to a surface parallel to the surface of the secondary transfer belt 71. Further, the shaft displacement member has a horizontal surface 78B parallel to the surface of the secondary transfer belt 71. The horizontal surface is disposed outboard the inclined face 78A. Since the above-described shaft 70S traverses the shaft displacement member 78, the shaft 70S is moved along with the shaft displacement member 78 that moves in X-direction in FIG. 3.

A shaft guide 82 is disposed in place in the image forming apparatus 1 so as to come into contact with the inclined face 78A or the horizontal surface 78B of the shaft displacement member 78. Even if the shaft 70S and the shaft displacement member 78 move, the shaft guide 82 is secured so as not to move. As illustrated in FIG. 3, the shaft guide 82 contacts the horizontal surface 78B of the shaft displacement member 78 when the secondary transfer belt 71 does not deviate outward in the axial direction of the shaft 70S. On the other hand, as illustrated in FIG. 4, the shaft guide 82 contacts the inclined face 78A of the shaft displacement member 78 when the secondary transfer belt 71 moves to one side and the belt contact member 77 moves the shaft displacement member 78 outward in the axial direction of the shaft 70S. As a result, the deviation correction roller 70 is inclined so that the shaft 70S on the one side where the inclined face 78A of the shaft displacement member 78 contacts the shaft guide 82 is lowered in the positive X-direction, thereby moving the bearing 73 and the side plate 72 downward indicated by arrow D in FIG. 2.

The deviation correction roller 70 is inclined against the upward biasing force indicated by arrow U in FIG. 2 with the shaft support spring 75 illustrated in FIG. 2. This is because, as described above, the side plate 72 is rotatable around the shaft 24S of the secondary transfer roller 24 and biased upward (i.e., in the direction indicated by arrow U in FIG. 2) with the shaft support spring 75 as illustrated in FIG. 2. The side plate 72 supports the bearing 73 disposed outboard the shaft guide 82 in the axial direction of the shaft 70S.

Operation of the belt regulator is described below.

As illustrated in FIGS. 3 and 4, when the deviation correction roller 70 that stretches the secondary transfer belt 71 rotates along with rotation of the secondary transfer belt 71, the secondary transfer belt 71 may move laterally in the axial direction of the shaft 70S (i.e., belt crawl occurs) because, for example, the plurality of rollers is not parallel to each other. As the secondary transfer belt 71 moves outward in the axial direction of the shaft 70S, the belt end 71P contacts the flat portion 77A of the belt contact member 77, and the secondary transfer belt 71 rotates in the direction indicated by arrow A in FIG. 2 while the belt end 71P contacts the flat portion 77A.

After the belt end 71P contacts the belt contact member 77, if the secondary transfer belt 71 further moves outward in the axial direction of the shaft 70S, the belt contact member 77 moves outward in the axial direction of the shaft 70S. Then, the belt contact member 77 contacts and presses the shaft displacement member 78 outward in the axial direction of the shaft 70S. As the belt contact member 77 presses the shaft displacement member 78, the shaft displacement member 78 moves outward in the axial direction of the shaft 70S. As a result, the shaft 70S moves downward while the shaft guide 82 contacts the inclined face 78A of the shaft displacement member 78 as illustrated in FIG. 4, thereby inclining the deviation correction roller 70. Thus, after the shaft 70S on the one side is lowered downward and the deviation correction roller 70 is inclined, the secondary transfer belt 71 is moved as follows to correct belt crawl.

Figure 5A:
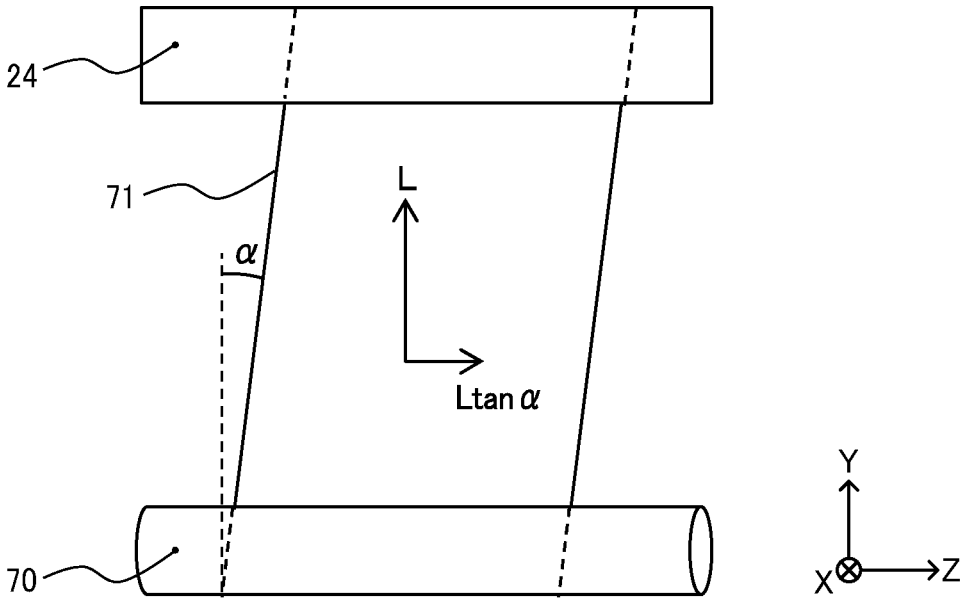
FIGS. 5A and 5B are schematic views illustrating alignment of the belt.
Figure 5B:
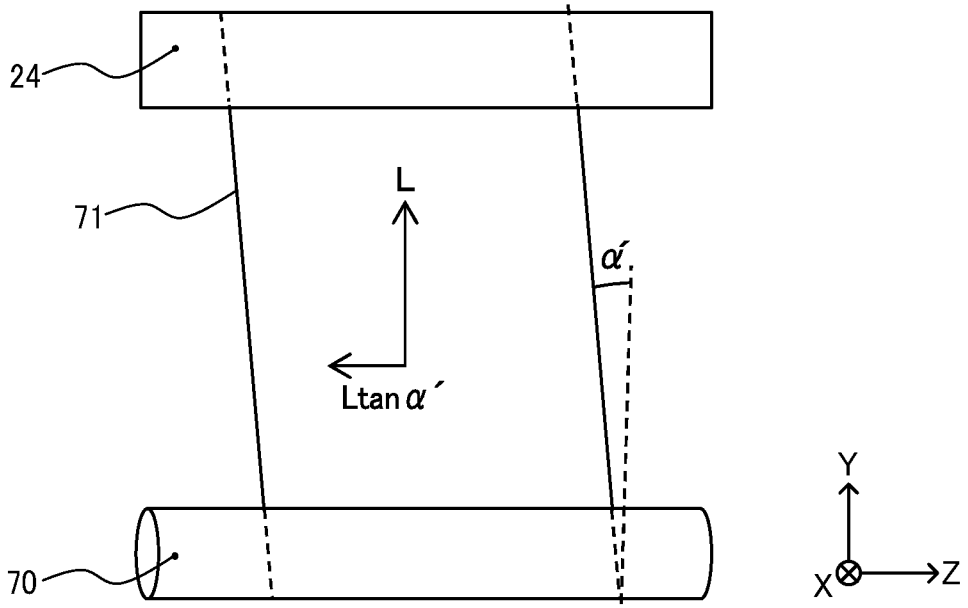

FIGS. 5A and 5B are plan views schematically illustrating components of the secondary transfer unit 23 for describing correction of belt crawl. The secondary transfer belt 71 is stretched between the secondary transfer roller 24 and the deviation correction roller 70, and upper and lower stretched portions of the secondary transfer belt 71 extend between the secondary transfer roller 24 and the deviation correction roller 70. In FIGS. 5A and 5B, only the lower stretched portion is depicted. As illustrated in FIG. 2, the secondary transfer belt 71 rotates in the direction indicated by arrow A in FIG. 2 as the secondary transfer roller 24 is rotated by a driver. In other words, a portion of the secondary transfer belt 71 wound around the deviation correction roller 70 rotates in a direction from top to bottom of the deviation correction roller in FIG. 2. At that time, the lower stretched portion of the secondary transfer belt 71 moves from the deviation correction roller 70 toward the secondary transfer roller 24. That is, the secondary transfer belt 71 moves from the lower side to the upper side in FIGS. 5A and 5B.

In FIG. 5A, the secondary transfer roller 24 is parallel to the Y-Z plane, and the deviation correction roller 70 is inclined so that the left end is lower than the right end of the deviation correction roller 70 in the X-direction (far side of the surface of the paper on which FIG. 5A is drawn). As illustrated in FIGS. 1 and 2, the deviation correction roller 70 is disposed lower than the secondary transfer roller 24 even in a state in which the deviation correction roller 70 is parallel to the Y-Z plane. That is, the deviation correction roller 70 is located obliquely below the secondary transfer roller 24. The deviation correction roller 70 is inclined so that the left end is lower than the right end of the deviation correction roller 70 with respect to the Y-Z plane in FIG. 5A.

The secondary transfer belt 71 moves to the left side in FIG. 5A and the inclined face 78A of the shaft displacement member 78 contacts the shaft guide 82 on the left side, instead of the right side as illustrated in FIG. 4. As a result, the shaft 70S is lowered along with the shaft displacement member 78 on the left side, thereby inclining the deviation correction roller 70. When the deviation correction roller 70 is inclined, the direction in which the secondary transfer belt 71 travels is angled by an angle $\alpha$. In this state, as the secondary transfer belt 71 travels a distance L in Y-direction, the secondary transfer belt 71 moves in the positive Z-direction (the direction toward the right side in FIG. 5A) by a distance L tan $\alpha$. That is, the secondary transfer belt 71 stretched by the deviation correction roller 70 returns to the front side of the secondary transfer unit 23 in the axial direction of the shaft 70S (positive Z-direction or to the right in FIG. 5A). As a result, the belt crawl of the secondary transfer belt 71 is corrected so that the position of the secondary transfer belt 71 moves in the direction to return to the original position in the axial direction of the shaft 70S.

In FIG. 5B, contrary to FIG. 5A, the deviation correction roller 70 is inclined so that the right end is lower than the left end of the deviation correction roller 70 in the X-direction (far side of the surface of the paper on which FIG. 5B is drawn). The secondary transfer belt 71 moves to the right side in FIG. 5B and the inclined face 78A of the shaft displacement member 78 contacts the shaft guide 82 on the right side as illustrated in FIG. 4. As a result, the shaft 70S is lowered along with the shaft displacement member 78 on the right side, thereby inclining the deviation correction roller 70. When the deviation correction roller 70 is inclined, the direction in which the secondary transfer belt 71 travels is angled by an angle $\alpha'$. In this state, as the secondary transfer belt 71 travels a distance L in the Y-direction, the secondary transfer belt 71 moves in the negative Z-direction (the direction opposite to the movement in FIG. 5A) by a distance L tan $\alpha'$. That is, the secondary transfer belt 71 stretched around the deviation correction roller 70 returns to the rear side of the secondary transfer unit 23 in the axial direction of the shaft 70S (negative Z-direction or to the left in FIG. 5B). As a result, the belt crawl of the secondary transfer belt 71 is corrected so that the position of the secondary transfer belt 71 moves in the direction to return to the original position in the axial direction of the shaft 70S.

Belt crawl is largely due to the parallelism of the plurality of stretch rollers. However, other factors also cause belt crawl. Specifically, differences in the outer diameter in the longitudinal direction of the stretch roller or the inner circumference in the axial direction of the secondary transfer belt 71 can also cause belt crawl.

Figure 6:
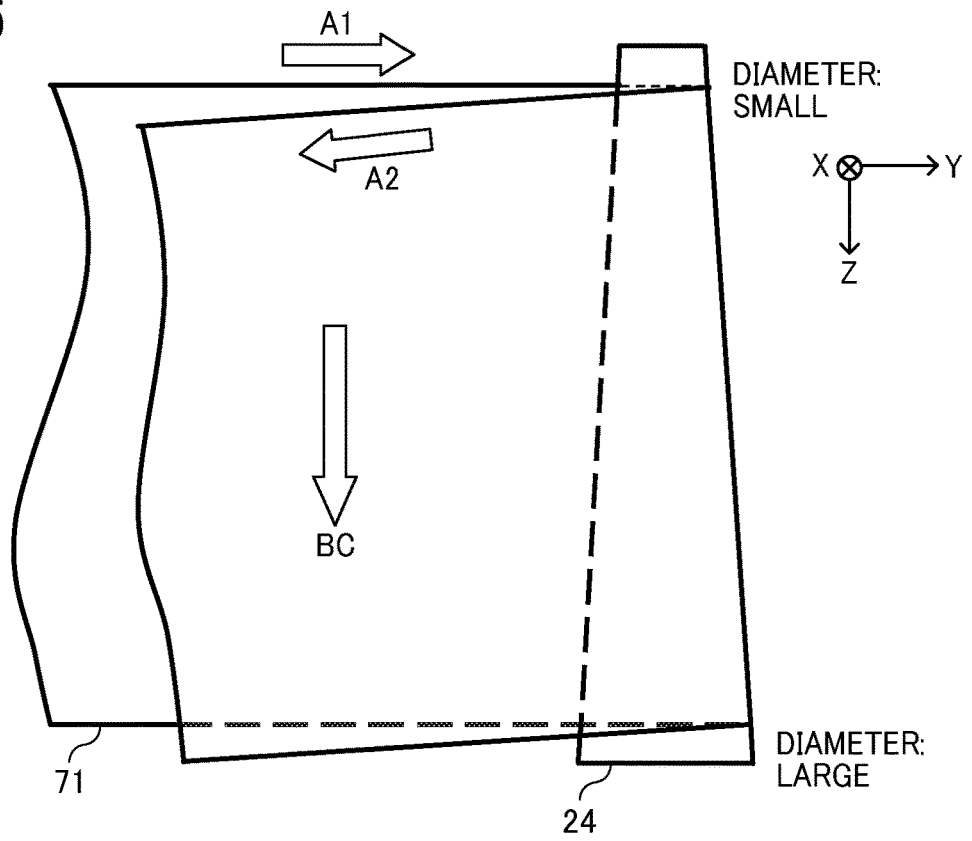
FIG. 6 is a schematic view illustrating an effect of differences in an outer diameter of a stretch roller included in the belt device.

FIG. 6 is a schematic view illustrating an effect of the differences in the outer diameter in the longitudinal direction of the stretch roller. The differences in the outer diameter cause a difference between an approaching angle and a departing angle of the second transfer belt 71 as indicated by arrows A1 and A2. The secondary transfer belt 71 is likely to move from one side at which the outer diameter of the stretch roller (secondary transfer roller 24 in FIG. 6) is small toward the other side at which the outer diameter of the stretch roller is large as illustrated by arrow BC in FIG. 6.

Figure 7:
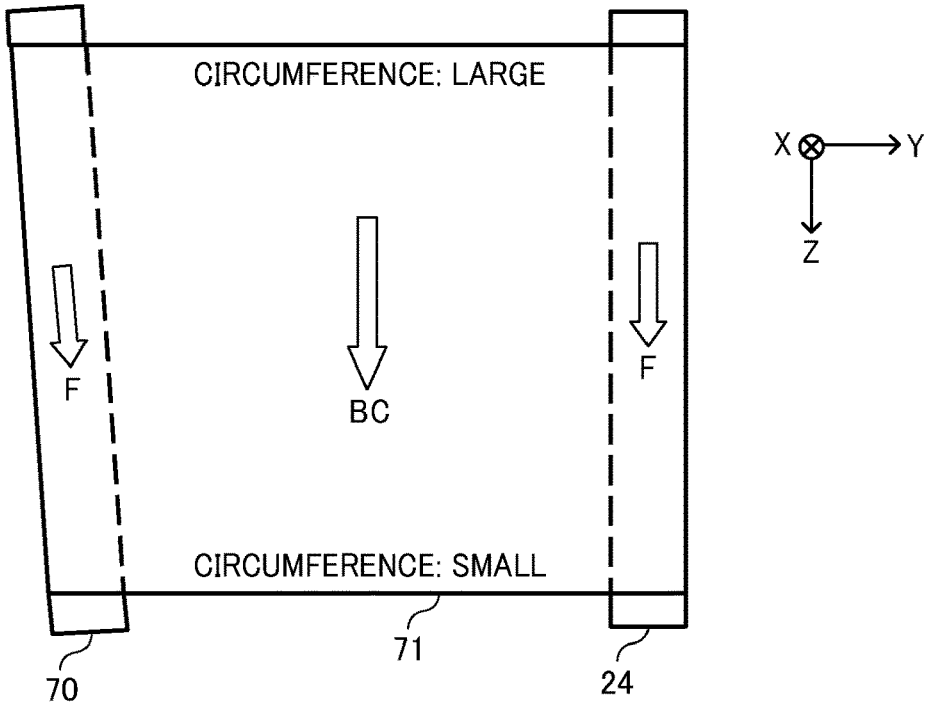
FIG. 7 is a schematic view illustrating an effect of differences in a circumference of the belt.

FIG. 7 is a schematic view illustrating an effect of the differences in the inner circumference in the axial direction of the secondary transfer belt 71. With the differences in the inner circumference of the secondary transfer belt 71, frictional force F is generated against a portion of the secondary transfer belt 71 wound around the stretch roller from one side at which the inner circumference of the secondary transfer belt 71 is large toward the other side at which the inner circumference of the secondary transfer belt 71 is small. As a result, the secondary transfer belt 71 is likely to move from the one side toward the other side as illustrated by arrow BC in FIG. 7.

As described above, many factors cause belt crawl, for example, the parallelism between the stretch rollers, the differences in the outer diameter in the longitudinal direction of the stretch roller, and the differences in the inner circumference in the axial direction of the secondary transfer belt 71. When multiple factors overlap or the effect of any single factor is very large, the theoretical distance L tan $\alpha'$ to return the secondary transfer belt 71 illustrated in FIG. 5B may not be obtained. In particular, if the coefficient of friction between the deviation correction roller 70 and the inner circumferential surface of the secondary transfer belt 71 is low, the deviation correction roller 70 and the secondary transfer belt 71 may slip in the axial direction.

Thus, when multiple factors, such as the differences in the inner circumference of the secondary transfer belt 71 and the differences in the outer diameter of the stretch roller, overlap, the force to move the secondary transfer belt 71 laterally is superior to the force to return the secondary transfer belt 71 to the original position. Accordingly, the alignment of the secondary transfer belt 71 may be uncontrollable. If the alignment of the secondary transfer belt 71 is uncontrollable, the load of the edge of the secondary transfer belt 71 increases, and the secondary transfer belt 71 may be cracked or broken at the edge.

In the present embodiment, even when multiple factors, such as the differences in the inner circumference of the secondary transfer belt 71 and the differences in the outer diameter of the stretch roller, overlap, the secondary transfer belt 71 can be driven to rotate stably without cracking or breaking the edge of the secondary transfer belt 71.

Figure 8A:
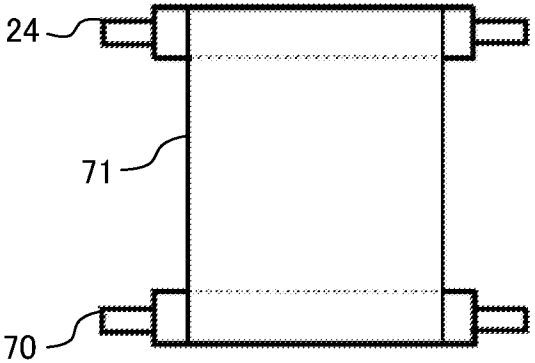
FIG. 8A is a schematic view of a comparative belt device.
Figure 8B:
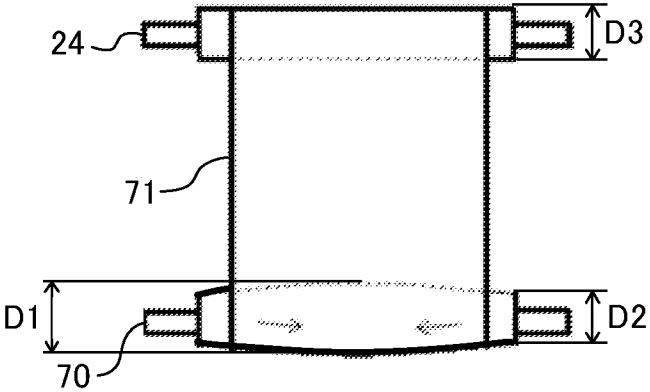
FIG. 8B is a schematic view of the belt device according to an embodiment of the present disclosure.
Figure 8C:
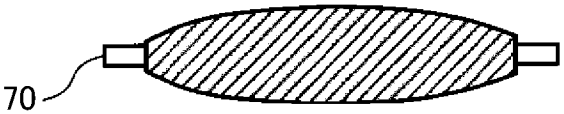
FIGS. 8C to 8D are schematic views of a stretch roller according to an embodiment of the present disclosure.

FIG. 8A illustrates a comparative belt device, and FIG. 8B illustrates the belt device according to the present embodiment. FIG. 8C is a cross-sectional view of the deviation correction roller 70 along the axial direction according to the present embodiment.

In the present embodiment, as illustrated in FIGS. 8B and 8C, the deviation correction roller 70 around which the secondary transfer belt 71 is entrained has a crown shape or barrel shape in which the diameter at the center of the deviation correction roller 70 in the axial direction is greater than the diameter at the ends in the axial direction. As a result, the secondary transfer belt 71 is likely to move inward (or toward the center in the width direction of the deviation correction roller 70). Therefore, the force to move the secondary transfer belt 71 laterally does not overcome the force to return the secondary transfer belt 71 to the original position even when multiple factors, such as the deviation of circumference of the secondary transfer belt 71 and the differences in the outer diameter of the stretch roller, overlap. Accordingly, alignment of the secondary transfer belt 71 is controllable.

Figure 8D:
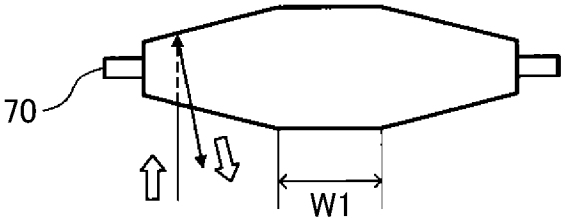

FIG. 8D is a schematic view illustrating the principle in which the secondary transfer belt 71 is likely to move inward (or toward the center in the width direction of the deviation correction roller 70). Similarly to the principle described above with reference to FIGS. 5A and 5B, after the secondary transfer belt 71 is wound around the deviation correction roller 70 having the crown shape (barrel shape), the secondary transfer belt 71 departs from the deviation correction roller 70 toward the center in the width direction, at which the diameter of the deviation correction roller 70 is large, as indicated by blank arrows in FIG. 8D. In FIG. 8D, the deviation correction roller 70 has sloped portions whose diameter becomes larger toward the center in the axial direction. When the secondary transfer belt 71 is close to one side, force to move the secondary transfer belt 71 toward the center is greater at the one side, in which an area of the secondary transfer belt 71 wound around the deviation correction roller 70 is large, than force at the other side. For this reason, for example, when the secondary transfer belt 71 is deviated to the left in FIG. 8D, the secondary transfer belt 71 moves toward the right in FIG. 8D. On the other hand, when the secondary transfer belt 71 deviates to the right in FIG. 8D, the secondary transfer belt 71 moves toward the left in FIG. 8D.

In the crown shape (barrel shape) in FIG. 8D, a predetermined width range W1 of the center portion of the deviation correction roller 70 in the width direction is straight (i.e., a straight shape in a cross-sectional view along the axis of the deviation correction roller 70), thereby facilitating dimensional control of the diameter.

Further, the deviation correction roller 70 also serves as a sheet separation roller, and the crown shape (barrel shape) of the deviation correction roller 70 enables the recording sheet to start separating from the ends of the deviation correction roller 70 gradually, thereby facilitating the separation of the recording sheet. In addition, the recording sheet gradually separates from the end, thereby reducing separating discharge. As a result, the occurrence of images with dust particles generated downstream from the deviation correction roller 70 is minimized.

A diameter at the center (i.e., a center diameter D1) and a diameter at the end (i.e., an end diameter D2) of the deviation correction roller 70 having the crown shape, and a diameter D3 of the secondary transfer roller 24 are different from each other. This construction is chosen because, if the diameters of the deviation correction roller 70 and the secondary transfer roller 24 are the same, then when the deviation correction roller 70 and the secondary transfer roller 24 are assembled so that phases having poor roundness of the deviation correction roller 70 and the secondary transfer roller 24 coincide, the speed fluctuation of the secondary transfer belt 71 may become larger at the pitch of rotation of the deviation correction roller 70 and the secondary transfer roller 24, causing the secondary transfer belt 71 to rotate unstably. However, in the present embodiment, this problem does not occur because the phases are shifted if the diameters are different.

The relation between the center diameter D1 and the end diameter D2 of the deviation correction roller 70 having the crown shape and the diameter D3 of the secondary transfer roller 24 is expressed by the following relation, $$D3>D1>D2.$$

For example, the diameter D3 of the secondary transfer roller 24 is 24.68 mm, the center diameter D1 of the deviation correction roller 70 is 14 mm, and the end diameter D3 of the deviation correction roller 70 is 13.9 mm. The values described above are merely examples, and it is desirable that appropriate diameters are set within the relation of the diameter D3 of the secondary transfer roller 24 > the center diameter D1 of the deviation correction roller 70 > the end diameter D2 of the deviation correction roller 70.

As described above, according to the present embodiment, the deviation correction roller 70, which is one of the plurality of stretch rollers, has the crown shape (barrel shape). Therefore, the force to move the secondary transfer belt 71 laterally does not overcome the force to return the secondary transfer belt 71 to the original position even when multiple factors, such as the differences in the inner circumference of the secondary transfer belt 71 and the differences in the outer diameter of the stretch roller, overlap. Accordingly, the alignment of the secondary transfer belt 71 is controllable.

Further, since the center diameter and the end diameter of the crown-shaped stretch roller such as the deviation correction roller 70 are different from the diameter of the other stretch rollers such as the secondary transfer roller 24, the phases of the pitches of rotation of the deviation correction roller 70 and the secondary transfer roller 24 do not coincide, enabling the secondary transfer belt 71 to rotate stably.

Further, since the cleaning blade 79 to clean the surface of the secondary transfer belt 71 contacts a portion of the secondary transfer belt 71 wound around the secondary transfer roller 24 that is not crown-shaped, a normal flat plate blade can be used as the cleaning blade 79 without matching the crown shape.

As a result, according to the present disclosure, belt alignment can be improved.

Figure 9:
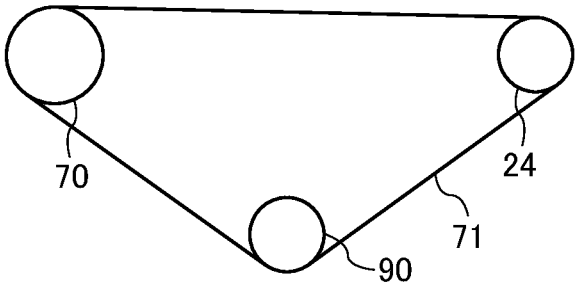
FIG. 9 is a schematic view of a variation of the belt device according to an embodiment of the present disclosure.

In the above-described embodiments illustrated in the drawings, one of the two stretch rollers is used as the deviation correction roller 70, but the present disclosure can also be applied to a belt device in which three or more stretch rollers stretch the secondary transfer belt 71. FIG. 9 illustrates an example of the belt device provided with the three stretch rollers. A tension roller 90 is employed in addition to the deviation correction roller 70 and the secondary transfer roller 24 that is a drive roller. It is preferable to have the above-described relation among the center diameter D1 and the end diameter D2 of the deviation correction roller 70 having the crown shape and the diameter D3 of the secondary transfer roller 24. The diameter D4 of the tension roller 90 is preferably different from the center diameter D1 and the end diameter D2 of the deviation correction roller 70 and the diameter D3 of the secondary transfer roller 24.

In the above-described embodiments, the deviation correction roller 70 among the plurality of stretch rollers has the crown shape, but the secondary transfer roller 24 can have the crown shape instead of the deviation correction roller 70.

Moreover, although the present disclosure is applied to the secondary transfer belt 71 but can be applied also to another belt. For example, the present disclosure can also be applied to a belt such as an intermediate transfer belt that carries a toner image transferred from a photoconductor and transfers the toner image onto a recording sheet, or a conveyance belt that conveys the recording sheet.

Further, the present disclosure can be applied not only to the belt device used in the image forming apparatus 1 but also to a belt device used in other devices.

Further, although the belt alignment mechanism based on the shaft inclination method is employed, the present disclosure can also be applied to a belt device employing another type of belt alignment mechanism. For example, the present disclosure can also be applied to a belt device employing a belt alignment mechanism of pressing belt end.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A belt device, comprising:

a belt configured to rotate;

a plurality of stretch rollers configured to stretch the belt, wherein the belt is wound around the plurality of stretch rollers; and a belt alignment mechanism configured to align the belt, wherein at least one stretch roller of the plurality of stretch rollers litwing has a diameter at a center greater than diameters at both ends in an axial direction of the at least one stretch roller, and the diameter at the center and the diameters at both ends of the at least one stretch roller are different than a diameter of et-lief another stretch roller of the plurality of stretch rollers.

2. The belt device according to claim 1, wherein the belt alignment mechanism is disposed on one stretch roller of the plurality of stretch rollers and is configured to move in the axial direction as the belt moves in the axial direction, and the belt alignment mechanism includes:

a shaft displacement member having an inclined face that is inclined relative to a surface of the belt; and a shaft guide secured opposite the inclined face.

3. The belt device according to claim 2, wherein the belt alignment mechanism is disposed on the at least one stretch roller.

4. The belt device according to claim 1, wherein the at least one stretch roller is disposed obliquely below another stretch roller of the plurality of stretch rollers.

5. The belt device according to claim 1, wherein a portion of the belt wound around the at least one stretch roller rotates in a direction from top to bottom of the at least one stretch roller.

6. The belt device according to claim 1, further comprising:

a cleaning device configured to clean a surface of the belt wound around the stretch roller and the other stretch roller, wherein the cleaning device contacts the belt at a position other than a position where the belt is wound around the at least one stretch roller.

7. An image forming apparatus comprising a printer that comprises the belt device according to claim 1.

8. A belt regulator, comprising:

a plurality of stretch rollers configured to stretch a belt, wherein the belt is wound around the plurality of stretch rollers; and first and second belt alignment mechanisms that are each configured to align the belt, wherein at least one stretch roller of the plurality of stretch rollers has a diameter at a center greater than diameters at both ends in an axial direction of the at least one stretch roller, the diameter at the center and the diameters at both ends of the at least one stretch roller are different than a diameter of another stretch roller of the plurality of stretch rollers, the first belt alignment mechanism is positioned at one end of the at least one stretch roller, and the second belt alignment mechanism is positioned at another end of the at least one stretch roller.

9. An image forming apparatus comprising a printer that comprises the belt regulator according to claim 8.

* * * * *